US006132137A

United States Patent [19]

Gunter

[11] Patent Number: 6,132,137

[45] Date of Patent: Oct. 17, 2000

[54] DRAINABLE FIELDS AND ASSOCIATED METHODS

[75] Inventor: Charles E. Gunter, Statesville, N.C.

[73] Assignee: ABT, Inc., Troutman, N.C.

[21] Appl. No.: 09/096,105

[22] Filed: Jun. 11, 1998

Related U.S. Application Data

[62] Division of application No. 08/857,359, May 16, 1997, Pat. No. 5,779,393, which is a division of application No. 08/568,301, Dec. 6, 1995, Pat. No. 5,647,689.

[51] Int. Cl.[7] ..... E02B 13/00; E02B 5/00

[52] U.S. Cl. ..... 405/36; 404/2; 404/4; 405/118; 405/52; 405/121

[58] Field of Search ..... 405/119–121; 404/2, 4, 26, 25, 47; 16/16, 8

[56] References Cited

U.S. PATENT DOCUMENTS

| | | | |
|---|---|---|---|
| Re. 26,366 | 4/1968 | Flegel . | |
| Re. 33,439 | 11/1990 | Thomann et al. . | |
| 3,144,678 | 8/1964 | Casse | 16/16 |
| 3,218,943 | 11/1965 | Bowman | 404/26 |
| 3,254,361 | 6/1966 | Brunn et al. | 16/16 |
| 3,418,897 | 12/1968 | Humalainen | 472/92 |
| 3,433,137 | 3/1969 | Henderson . | |
| 3,543,326 | 12/1970 | Rohrberg et al. | 16/16 |
| 3,625,011 | 12/1971 | Stevenson . | |
| 4,007,307 | 2/1977 | Friedrich | 428/17 |
| 4,312,504 | 1/1982 | Rutledge et al. . | |
| 4,472,078 | 9/1984 | Karbstein . | |
| 4,505,814 | 3/1985 | Marshall | 404/26 X |
| 4,515,498 | 5/1985 | Thomann et al. . | |
| 4,553,874 | 11/1985 | Thomann et al. . | |
| 4,560,302 | 12/1985 | Karbstein . | |
| 4,621,939 | 11/1986 | Thomann et al. . | |
| 4,630,962 | 12/1986 | Thomann et al. . | |
| 4,630,966 | 12/1986 | Karbstein . | |
| 4,640,643 | 2/1987 | Williams . | |
| 4,699,544 | 10/1987 | Karbstein . | |
| 4,751,945 | 6/1988 | Williams . | |
| 4,787,773 | 11/1988 | Kehler . | |
| 4,838,727 | 6/1989 | Capuano . | |
| 4,909,664 | 3/1990 | Spiess et al. | 405/52 X |
| 4,913,596 | 4/1990 | Lambert, III . | |

(List continued on next page.)

FOREIGN PATENT DOCUMENTS

| | | |
|---|---|---|
| 0056238 | 7/1982 | European Pat. Off. . |
| 0109065 | 5/1984 | European Pat. Off. . |
| 5-132909 | 5/1993 | Japan . |

OTHER PUBLICATIONS

*Polydrain® Special Products* pamphlet by ABT®, Inc.

*Aco Sport® Running Track Drainage & Bordering* pamphlet by ACO Polymer Products, Inc., Lit. No. Jan. 1, 1989 Copyright 1989.

*Polydrain® The Simple Solution To Surface Drainage Sloped System Manuel*by ABT®, Inc., Copyright 1992.

*Primary Examiner*—Dennis L. Taylor
*Attorney, Agent, or Firm*—Alston & Bird LLP

[57] ABSTRACT

An elongate grate capable of securing an edge portion of an artificial turf surface within a drainage channel is provided. The grate includes an elongate central portion defining a plurality of openings to permit runoff from the artificial turf surface to flow into the drainage channel. Connected to at least one exterior edge of the central portion is a downwardly extending wall portion being interior of the exterior edge for applying a downwardly directed engagement force to the edge portion of the artificial turf surface. According to another embodiment of the grate, an elongate slot is integrally defined in the central portion having a width such the edge portion of the artificial turf can be frictionally engaged therein. According to yet another embodiment, a grate is provided with a central portion positioned between opposed edge portions and defines a plurality of openings therein such that an impervious athletic surface can be formed over each of the edge portions. Associated methods of forming drainable athletic playing surfaces also form a part of the invention.

18 Claims, 3 Drawing Sheets

U.S. PATENT DOCUMENTS 4,940,359 7/1990 Van Duyn et al. .
5,060,439 10/1991 Clements et al. ..... 404/47 X
5,106,231 4/1992 Thomann .
5,110,235 5/1992 Thomann et al. .
5,120,157 6/1992 Todd, Sr. et al. .
5,135,331 8/1992 Steiner .
5,213,438 5/1993 Bärenwald .
5,226,748 7/1993 Bärenwald et al. .
5,256,000 10/1993 Beamer ..... 405/119

DRAINABLE FIELDS AND ASSOCIATED METHODS

RELATED APPLICATIONS

The present application is a divisional of U.S. patent application Ser. No. 08/857,359, filed May 16, 1997, now U.S. Pat. No. 5,779,393 which is a divisional of U.S. patent application Ser. No. 08/568,301, filed Dec. 6, 1995, now issued as U.S. Pat. No. 5,647,689 on Jul. 15, 1997.

FIELD OF THE INVENTION

The present invention relates to athletic playing surfaces, and more particularly relates to drainage channel grates and associated methods for use with athletic playing surfaces.

BACKGROUND OF THE INVENTION

Athletic playing fields such as football and soccer fields or running tracks are typically provided with a drainage channel system formed alongside the playing surface for receiving and collecting liquid runoff. In particular, running track surfaces may include a polymeric surface which is substantially impervious, making adequate drainage very important. Artificial and natural turf playing surfaces are generally more porous than a running track and may include other drainage systems thereunder, but a drainage channel along the edge of the playing surface may nevertheless be important for draining excess runoff.

For outdoor athletic facilities, a drainage channel system is mainly used for draining rainwater. However, a drainage channel system may also be important in indoor or covered athletic facilities for draining other liquids such as water or solvents used to clean the athletic surface. In either instance, the particular athletic surface may be slightly crowned or sloped from the center to the edges to facilitate drainage therefrom.

A drainage channel system typically includes an elongate and substantially continuous drainage channel extending around the periphery of the athletic surface. The drainage channel may be positioned along the border between athletic surfaces of different types. For example, the drainage channel may be located between a polymeric running track and an artificial turf or natural grass playing field.

An elongate grate is typically provided over the drainage channel so as to cover the open top of the channel in order to prevent people from unwittingly stepping into the open channel and/or to prevent relatively large objects from entering the channel and partially blocking the flow of liquid therethrough. While the grate effectively covers the open top of the drainage channel, the drainage system and, in particular, the portion of the grate which is exposed to the surface can decrease the aesthetic appeal of the athletic playing fields. The drainage channel can also be slightly sloped to enhance flow within the channel. Further, the drainage system can include one or more catch basins along the channel to collect solid debris and pass the liquid to effluent pipes for removal from the playing field.

As will be apparent to those skilled in the art, the edges of an artificial turf surface must generally be anchored or secured in a fixed position to prevent unwanted movement of the artificial turf surface. Thus, several drainage systems have been developed which not only receive runoff from the artificial turf surface, but also anchor an edge of the artificial turf surface.

For example, a drainage system is commercially available under the trademark ACO SPORT® from Aco Polymer Products, Inc. which also serves to anchor the edge of an artificial turf surface. The ACO SPORT® drainage system includes a number of drainage channel configurations which, in some embodiments, are covered by a variety of grates and/or a polymer concrete hard cover. More specifically, Model Nos. AS-130 and AS-145 of the ACO SPORT® drainage system not only provide drainage for the adjacent playing surfaces, but also anchor an edge of the artificial turf surface.

In particular, ACO SPORT® drainage system Model No. AS-130 includes a grate which extends across the open top of a drainage channel. The opposed edges of the grate include a vertically extending downturned portion which cooperates with an upper portion of a sidewall of the drainage channel to clamp the edge of the artificial turf surface therebetween. However, the artificial turf surface which is clamped between the grate and the sidewall of the drainage channel has a finite thickness. Thus, in embodiments in which the AS-130 drainage channel extends between an artificial turf surface and a polymer running track, the grate may be slightly unlevel since the artificial turf surface is clamped between the edge of the grate and the sidewall of the drainage channel which is adjacent to the artificial turf surface.

Regardless of the manner in which an artificial turf surface is anchored, it is desirable to maintain the artificial turf surface in a taut condition to prevent looseness between the artificial turf surface and the subsurface layers. Thus, the artificial turf surface is preferably stretched taut during the installation and anchoring process to minimize, if not eliminate, undesirable looseness as the artificial turf surface expands and contracts as the temperature increases and decreases, respectively. Since the grate of the ACO SPORT® Model No. AS-130 drainage system secures the edge of the artificial turf surface in the same position to which the artificial turf surface was previously stretched, however, the artificial turf surface must be fully stretched to the desired tension prior to installing the grate over the open top of the drainage channel.

In addition, ACO SPORT® drainage system Model No. AS-145 does not include a grate, but, instead, includes a polymer concrete hard cover which extends over at least a portion of the open top of the drainage channel. The polymer concrete hard cover includes a clamping jaw which receives and secures an edge of the artificial turf surface. The ACO SPORT® Model No. AS-145 drainage system also includes a border or curb formed of ethylene-propylene diene monomer ("EPDM") which delineates the boundary between an artificial turf infield and a surrounding running track. The artificial turf infield and the surrounding running track are at different levels, however, such that athletes or others must step over the EPDM border to pass between the artificial turf infield and the surrounding running track.

In addition to securing an edge of the artificial turf surface, the ACO SPORT® Model No. AS-145 drainage system also receives runoff from the adjacent playing surfaces. Since the polymer concrete hard cover covers at least a portion of the open top of the drainage channel, runoff is received from the adjacent playing surfaces through a number of openings defined within an edge portion of the polymer concrete hard cover under the EPDM border which borders the running track. Thus, runoff from the artificial turf surface must initially drain onto the surrounding track prior to passing through the openings and into the drainage channel.

The U.S. Pat. No. 4,312,504 to L. Rutledge, et al. also describes a system for anchoring artificial turf surfaces. In particular, the Rutledge '504 patent describes a system for converting from an artificial turf surface, such as a football field, to a natural grass or dirt surface, such as the infield area of a baseball diamond. As illustrated in FIG. 1 of the Rutledge '504 patent, the edges of a pair of adjacent artificial turf surfaces can be wedged into a slot defined in a concrete foundation. A rope-like retainer strip can then be forced down into and along the length of the slot to further secure the respective edges of the artificial turf surfaces. In order to remove one of the artificial turf surfaces to expose the underlying dirt surface, the retainer strip and the edges of the artificial turf can be removed from the slot defined by the concrete foundation. The edge of the remaining artificial turf surface can then be stretched over the concrete foundation, including over the slot, so as to be anchored to a wooden nailer.

As shown in FIG. 1 of the Rutledge '504 patent, an upper end of the slot is open to the ground and a lower end is in fluid communication with a sloped drain conduit to convey runoff from the artificial turf surfaces which enters the slot to a central collection area. However, runoff from the artificial turf surfaces must enter the drain conduit via the slot which is at least partially filled by the edges of the artificial turf surfaces and, in some instances, by a retainer strip. Thus, the capacity of runoff which the drainage system of the Rutledge '504 patent is able to receive may be undesirably limited in some instances.

European Patent Application No. EP 109,065A to K. Broermann which was published May 23, 1984 also describes a drainage system which can clamp the edge of an artificial turf surface. The drainage system of the Broermann application includes a number of stone blocks which define longitudinal slots into which an edge of the adjacent artificial turf surface can be pressed. As illustrated in the Broermann application, the slots include an undercut portion defined in one wall thereof. In order to secure the edge of the artificial turf surface within the slot, a number of wedges having a serrated surface can be inserted into the slots to press the edge of the artificial turf surface into the undercut portion of the slot.

In addition to securing the edge of an artificial turf surface, the slots defined by the stone blocks of the drainage system of the Broermann application are connected to drainage pipes to provide drainage of the artificial turf surface. However, runoff from the artificial turf must enter the drainage pipes via the slots defined by the stone blocks which are at least partially filled by the wedges and the artificial turf surface. Thus, the capacity of runoff which the drainage system of the Broermann application is able to receive may also be undesirably limited in some instances. In addition, the slots defined by the stone blocks are not covered by a grate, but are, instead, at least partially filled by the wedges. Therefore, the resulting upper surface defined by the artificial turf surface, the stone blocks and upper portions of the wedges may be somewhat unlevel and at least some portions of the slot may be fully exposed to the surface.

As described above, several drainage systems have been developed which not only receive runoff from an artificial turf surface, but also anchor an edge of the artificial turf surface. However, these drainage systems still do not fully address the needs of modern athletic playing surfaces. For example, the prior drainage systems do not further tension the artificial turf surface during the anchoring process so as to insure that the artificial turf surface will remain taut as the temperature fluctuates. In addition, the drainage capacity of some of these prior drainage systems is to be at least somewhat limited. Further, at least some of these prior drainage systems do not maintain the athletic playing surfaces which are adjacent to the opposed sides of the drainage channel in a level orientation in order permit athletes and others to more readily pass thereover.

SUMMARY OF THE INVENTION

The present invention is directed to drainage channels which include an improved grate such that the drainage channel can border an athletic playing surface. In one aspect, the grate of the present invention is capable of securing an edge portion of an artificial turf surface such that the drainage channel over which the grate is disposed can receive runoff from the artificial turf surface. In another aspect, the grate at least partially supports an athletic surface to reduce the surface area of the grate which is exposed while permitting the drainage channel to receive runoff from the athletic surface. Consequently, the various embodiments of the grates of the present invention allow a drainage channel to adaptively border a number of different types of athletic playing surfaces in an unobtrusive manner as described below.

In one embodiment, the elongate grate secures an edge portion of the artificial turf surface within the drainage channel. According to this embodiment, the elongate grate includes an elongate central portion extending between opposed exterior edges and over the open top of the drainage channel. The central portion defines a number of openings which permit runoff from the artificial turf surface to flow into the drainage channel. The grate of this embodiment also includes a downwardly extending wall portion connected to at least one exterior edge of the central portion. The downwardly extending wall portion is interior of the exterior edge of the central portion of the grate so as to apply a downwardly directed engagement force to the edge portion of the artificial turf surface. Accordingly, the artificial turf surface can be drawn further into the drainage channel, thereby tightening or drawing taut the artificial turf surface, by more tightly securing the grate to the drainage channel, such as with a fastener.

In one advantageous embodiment, the downwardly extending wall portion of the grate includes an engagement surface extending both downwardly and laterally inwardly in a direction away from the exterior edge of the central portion. The engagement surface is typically planar and generally defines an acute angle such as between about 60° and 80°, relative to the central portion. The downwardly extending wall portion can also include a serrated edge for further engaging the edge portion of the artificial turf surface. Alternatively, the downwardly extending wall portion can include a number of projections for further engaging the edge portion of the artificial turf surface.

Thus, the edge portion of the artificial turf surface can be disposed over an upper edge of a sidewall of the drainage channel and the grate can be positioned between the sidewalls and over the open top of the drainage channel such that the edge portion of the artificial turf surface is disposed between the upper edge of the sidewall of the drainage channel and the grate. Typically, the artificial turf surface has a predetermined thickness and a predetermined crush height. Thus, the grate of this aspect of the present invention can include at least one exterior edge having a predetermined thickness substantially equal to the difference between the predetermined thickness of the artificial turf surface and the predetermined crush height of the artificial turf surface. Thus, following installation of the drainage channel in the artificial turf surface, the upper surfaces of both the grate and the artificial turf surface will be substantially level. Accordingly, a smooth transition can be made from the artificial turf surface to the grate by either athletes or vehicles. In addition, by maintaining the upper surfaces of the grate and the artificial turf surface substantially level, the drainage channel, including the grate, of the present invention does not present a trip hazard to athletes or spectators passing over the drainage channel.

In an alternative embodiment, the artificial turf surface can be disposed over at least a portion of the grate such that the grate at least partially supports the artificial turf surface. According to this embodiment, the grate extends over the open top of the drainage channel and defines a number of openings over which the artificial turf surface is disposed. Thus, runoff from the artificial turf surface can flow through the artificial turf surface itself and through the openings defined by the grate and into the drainage channel. The grate of this embodiment also preferably includes an elongate slot integrally defined in the central portion of the grate by a pair of sidewalls which extend downwardly into the drainage channel from the upper surface of the grate. Thus, an edge portion of the artificial turf surface can be tucked into the slot and frictionally engaged therein. In order to retain the edge portion of the artificial turf surface within the slot, a securing member, such as a cord, can be removably disposed within the slot.

Preferably, the slot defined by the grate of this embodiment has a width at least as great as the predetermined crush height of the artificial turf surface. In one embodiment, however, the slot has a width at least as great as twice the predetermined crush height of the artificial turf surface such that the slot can receive and frictionally engage the edge portion of the artificial turf surface in a folded or overlapped position. Consequently, the grate of this embodiment preferably has a slot having a width between about 10 millimeters and about 25 millimeters. Further, the pair of sidewalls which define the slot of one advantageous embodiment are connected at lower portions thereof. In addition, the pair of sidewalls which define the slot of this embodiment can also define a number of openings in the connected lower portions thereof to permit runoff from the artificial turf surface to flow therethrough and into the drainage channel.

According to another embodiment of the present invention, the drainage channel including a grate according to the present invention can border an impervious athletic surface. According to one aspect of this embodiment of the present invention, the athletic surface can be disposed over a first portion of the grate such that the grate at least partially supports the athletic surface. However, a second portion of the grate which defines a number of openings is preferably free of the athletic surface. Thus, runoff from the impervious athletic surface can flow through the openings defined by the grate and into the drainage channel over which the grate extends.

In one embodiment, the grate defines a number of linearly disposed, spaced-apart openings. According to this embodiment, an edge adapter can be positioned on the grate, typically in an aligned relationship with at least some of the openings defined by the grate, prior to covering the first portion of the grate with the impervious athletic surface.

The edge adapter generally includes a base portion for supporting the edge adapter on the grate and which defines a number of openings at least partially aligned with corresponding openings defined by the grate such that runoff from the athletic surface can flow therethrough and into the drainage channel. The edge adapter can also include at least one upstanding portion extending upwardly from the base portion for defining the edge of the athletic surface.

In one embodiment, the impervious athletic surface extends over both opposed edge portions of the grate. According to this embodiment, the edge adapter is generally U-shaped and is disposed upon the portion of the grate which defines the openings so that it may define respective edges of the athletic surface. More specifically, the generally U-shaped edge adapter of this embodiment preferably includes a pair of upstanding portions extending upwardly from opposed sides of the base portion for defining respective edges of the athletic surface. A number of fastening members can also extend through the openings defined by the base portion and the grate for fastening the edge adapter to the grate. Thus, the upstanding portion of the edge adapter restrains the moldable material applied during the process of forming the athletic surface to prevent the moldable material from covering the second portion of the grate and to define an edge of the athletic surface following curing of the moldable material.

Therefore, the drainage channel and associated grates of the present invention permit the drainage channel to be installed adjacent a number of different types of athletic playing surfaces, such as running track surfaces and artificial turf surfaces. In addition, the various embodiments of the grate can support at least a portion of the various playing surfaces to reduce the surface area of the grate which is exposed. In addition, the grate is preferably configured such that the upper surfaces of the grate and the playing surfaces are level, thereby reducing trip hazards and allowing athletes, spectators and vehicles to readily pass thereover. Finally, the drainage channel including the various embodiments of the grates of the present invention continues to provide drainage for the athletic playing surfaces while defining an edge of the running track surface or securing the edge portion of an artificial turf surface.

BRIEF DESCRIPTION OF THE DRAWINGS

Some of the objects and advantages of the present invention having been stated, others will appear as the description proceeds, when taken in connection with the accompanying drawings, which are not necessarily drawn to scale, and wherein.

DETAILED DESCRIPTION OF THE PREFERRED EMBODIMENTS

Figure 1:
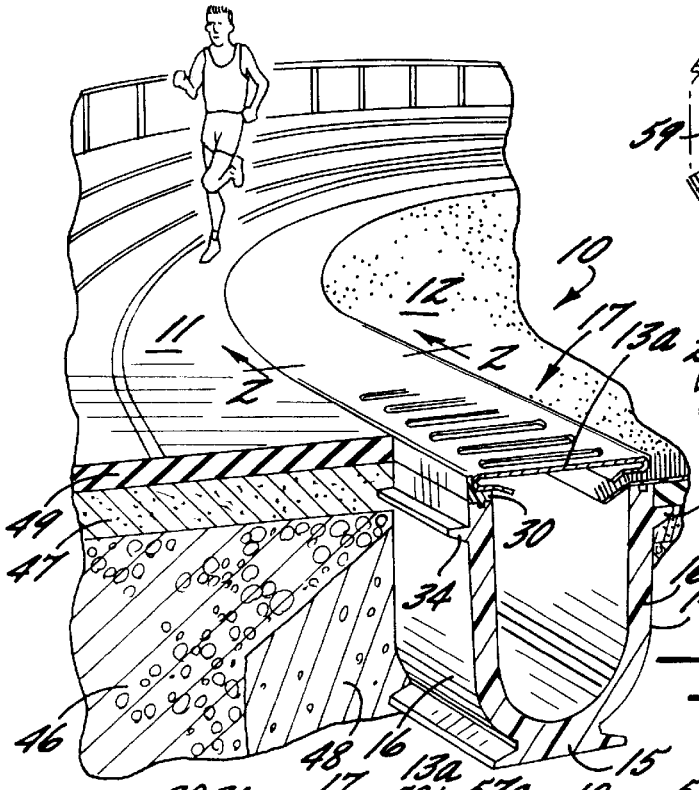
FIG. 1 is an environmental sectional view of a drainage channel having a grate according to a first embodiment of the present invention, illustrating a running track surface on one side and an artificial turf playing surface on the other side.

Various embodiments of the invention are set forth below. While the invention is described with reference to specific preferred devices and methods, including those illustrated in the drawings, it will be understood that the invention is not intended to be so limited. To the contrary, the invention includes numerous alternatives, modifications and equivalents as will become apparent from consideration of the present specification including the drawings, the foregoing discussion, and the following detailed description.

FIG. 1 illustrates a drainage channel 10 positioned along the interior edge of a running track 11. The drainage channel 10 may also be installed at other locations relative to the athletic playing surface in question, such as outside a running track surface or along the edges of other athletic playing fields. For example, an artificial turf playing surface 12 is illustrated on the opposite side of the drainage channel 10 of FIG. 1 and may be used for playing football or other field sports. In addition, the drainage channel 10 could border a natural turf field.

A grate 13*a*, according to one of the various embodiments of the invention, is provided over the drainage channel 10 to prevent injury and to prevent relatively large objects, such as leaves and debris, from entering the channel and restricting the flow of liquid therethrough. As can be seen in FIG. 1, and as discussed in more detail below, the grate 13*a* is arranged to provide a substantially planar and continuous transition surface between the running track 11 and the artificial turf 12 so that there are no protrusions which might trip athletes or interfere with the operation of various wheeled devices which may be used. Thus, the top of the drainage channel 10, running track 11, and artificial turf playing surface 12 are all at substantially the same level.

The drainage channel 10 may include a plurality of longitudinally extending preformed or precast drainage channel sections 14 arranged in an end-to-end relationship. The channel sections 14 can be precast from various cementitious materials depending upon the type of fluids which the channel 10 is to collect and the type of loads the channel is expected to support. For example, precast drainage channel sections 14 are typically formed of polyester concrete, a concrete aggregate material containing coarse and inert mineral fillers bonded with polyester resin. As will be apparent, according to certain embodiments of the invention, the channel sections 14 can be formed from other cementitious and/or thermoformable or thermosetting polymers or formed from cast or formed metals such as stainless steel sheet. The channel sections 14 could also be formed of fiberglass. A preferred drainage channel section is described in more detail in U.S. Pat. No. 5,653,553, entitled "Drainage Channel and Associated Method" to Charles E. Gunter filed concurrently herewith and assigned to the assignee of the present invention and which is incorporated herein by reference.

Figure 2A:
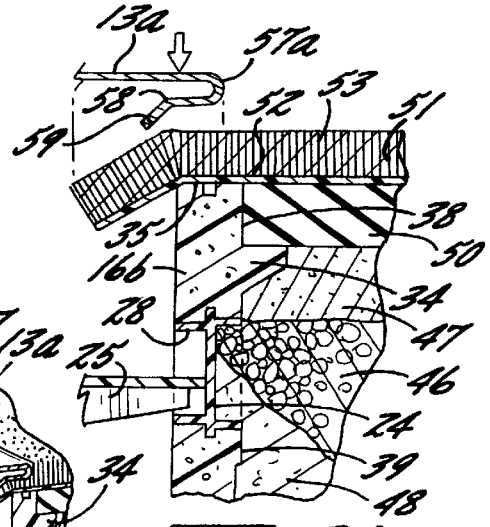
FIGS. 2A–2C illustrate the mounting of a grate of the first embodiment of the present invention over the open top of a drainage channel so as to engage the edge portion of the artificial turf surface between the grate and upper portions of the sidewall of the drainage channel and to apply a downwardly directed engagement force to the edge portion of the artificial turf surface.
Figure 2:
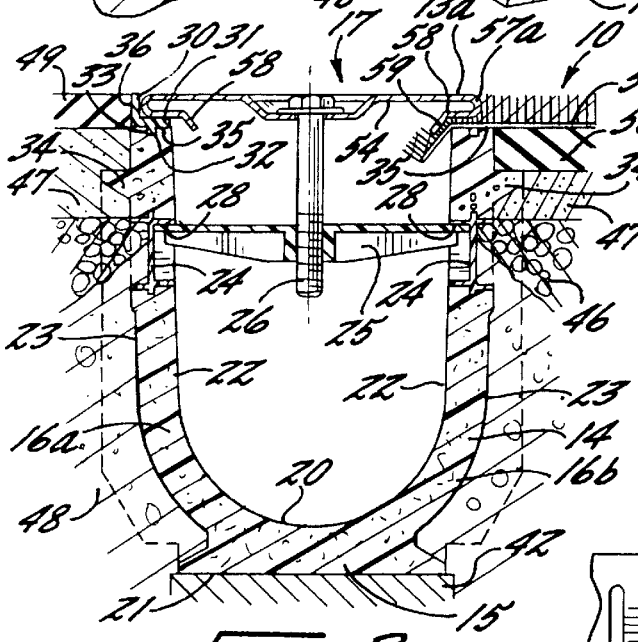
FIG. 2 is a sectional view of the drainage channel of FIG. 1 taken along line 2—2 FIG. 1 which more clearly illustrates the downwardly extending wall portion of this embodiment of the grate which applies a downwardly directed engagement force to the edge portion of the artificial turf surface disposed between the grate and upper portions of the sidewall of the drainage channel.

As illustrated in FIG. 2, the drainage channel section 14 may include a bottom wall 15 and a pair of sidewalls 16 extending upwardly from the opposed sides of the bottom wall so as to define an open top 17 for receiving the liquid runoff. The bottom wall 15 defines interior 20 and exterior 21 surfaces and the sidewalls 16 define interior 22 and exterior 23 surfaces. While the bottom wall 15 is shown to be thicker than the sidewalls 16, the relative dimensions of the bottom wall and the sidewalls can be readily varied without departing from the spirit and scope of the present invention. In addition, the interior surface 20 of the bottom wall 15 may be substantially U-shaped or V-shaped so as to blend into the interior surfaces 22 of the sidewalls 16. Additionally, the bottom wall 15 may have a uniform thickness along the length of the channel section 14, or, alternatively, the interior surface 20 of the bottom wall may be slightly sloped relative to the exterior surface 21 to enhance liquid flow along the channel 10.

The exterior surface 21 of the bottom wall 15 may be generally flat for stably supporting the drainage channel section 14, as discussed in more detail below. In addition, the exterior surface 21 of the bottom wall 15 may be extended outwardly when viewed in cross section so as to define a pedestal-type shape and to enhance the lateral stability of the drainage channel section 14. However, the bottom wall 15 can have other configurations without departing from the spirit and scope of the present invention.

The various embodiments of the grates described herein may be secured to the channel 10 by way of a locking block 24 carried in a recess in the sidewalls 16 in the manner disclosed in U.S. Pat. No. Re. 33,439 to Thomann et al. and assigned to the assignee of the present invention, which is incorporated herein by reference. As disclosed therein, a locking strap 25 is carried transversely by a bolt 26 rotatably mounted in the grate 13. The locking block 24 has an oblique wall therein which allows rotation of the locking strap 25 in the direction of tightening of the bolt 26. The locking strap is prevented, however, from rotating past a vertical wall of the locking block 24. Further tightening of the bolt 26 draws the locking strap 25 against an upper horizontal wall 28 of the locking block 24 and the grate 13*a* becomes securely fastened.

As shown in detail in FIG. 2A, the drainage channel can also include a pair of longitudinally elongate projections 34 which extend transversely outwardly from the exterior surfaces 23 of one or both sidewalls 16. As described below, the projections 34 are spaced at a predetermined distance below the open top 17. In addition, the projections 34 extend outwardly beyond at least a section 38 of the sidewall 16 above the projection and a section 39 of the sidewall below the projection. At least portions of the sections of the sidewall above 38 and below 39 the projection 34 may be generally coplanar with each other. These projections 34 are particularly advantageous for defining the horizontal level to which one or more subsurface layers should be formed adjacent to the channel 10.

As described hereinafter, a number of subsurface and surface layers surround the drainage channel in order to properly align and position both the drainage channel and the adjacent athletic playing surface. As shown in detail in FIGS. 4 and 7, the subsurface and surface layers formed adjacent to the channel include a base surface 40 which is formed by appropriate grading with earth-moving equipment. A plurality of pads 41 of concrete or other supportive material are then formed on the graded base surface 40. While the concrete pads 41 are still wet, a support 42 for the drainage channel sections 14, such as a cement brick, is placed on each pad. Each of the support bricks 42 is then aligned with the other bricks by making minor adjustments to the bricks in the wet concrete.

Figure 4:
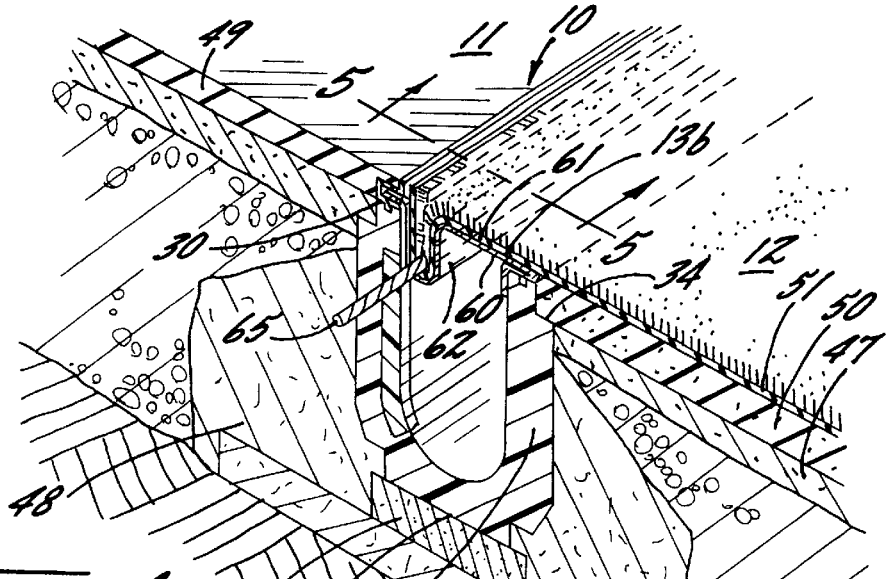
FIG. 4 is an environmental sectional view of a drainage channel having a grate according to a second embodiment of the present invention which illustrates a running track surface on one side and an artificial turf playing surface on the other side.
Figure 7:
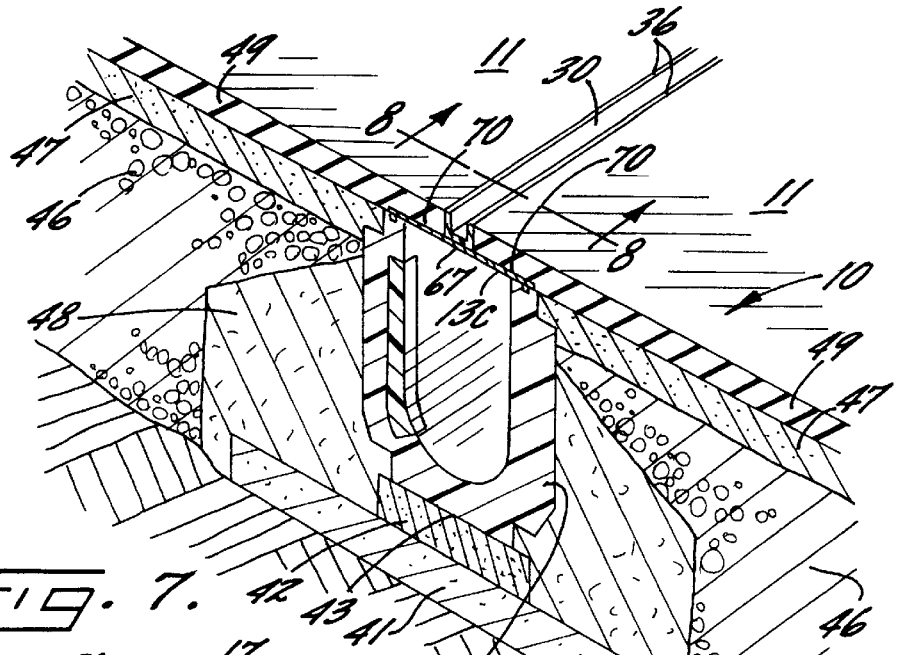
FIG. 7 is an environmental sectional view of a drainage channel having a grate according to a third embodiment of the present invention which illustrates impervious athletic surfaces on both sides of the drainage channel.

A drainage channel section 14 may then be placed on two adjacent support bricks 42. The exterior surface 21 of the bottom wall 15 of the drainage channel sections 14 may be provided with generally planar reference surfaces 43 which are shaped, such as by molding, to ensure that adjoining channel sections 14 supported on a common support brick 42 will be aligned in a predetermined positional relationship. Typically, the drainage channel sections include planar reference surfaces which are coplanar to ensure that the open tops 17 and the longitudinal elongate projections 34 of the adjoining channel sections are vertically aligned. In addition, the end surfaces of each drainage channel section 14 may be provided with a male/female structure as shown in FIGS. 4 and 7 such that either end of one channel section may be interlocked with either end of an adjoining channel section. A sealant or adhesive may be applied to the adjacent ends of the adjoining drainage channel sections to prevent leakage of the channel 10.

In order to secure the drainage channel, encasement concrete 48 may then be poured against the sidewalls 16 of the drainage channel 10. A layer of gravel, rock, or sand 46 may then be applied over the encasement concrete 48 as illustrated in FIG. 11, and an asphalt layer 47 can then formed over the gravel layer 46. The asphalt may be substantially porous or non-porous. The height or elevation to which the asphalt layer 47 is formed depends in part on the type of playing surface that is desired. For example, the left-hand side of the drainage channel 10 illustrated in detail in FIG. 2 is provided with a running track surface 11, and, accordingly, the asphalt layer 47 may be formed to a height or elevation even with a horizontal upper surface 31 of the adjacent sidewall 16*a*.

However, an artificial turf surface is shown on the right-hand side of the drainage channel illustrated in FIGS. 2 and 2A which is supported, at least in part by a somewhat thinner asphalt layer 47. As shown, the asphalt layer 47 is typically formed to a height corresponding to that of the outwardly extending projection 34 on the corresponding sidewall 16*b*. This projection 34 is preferably spaced at a predetermined distance below the open top 17 that corresponds to the thickness of a foam layer 50 which overlies the asphalt layer and supports the artificial turf 51 which will be placed thereabove. This predetermined thickness is between about ¼ of an inch and one inch, and is preferably about ⅝ ths of an inch. The longitudinal elongate projection thus advantageously serves as an installation guide for installers when forming the asphalt layer 47 so as to ensure that the subsurface layers are formed to the proper elevations such that the uppermost surface of the athletic playing surface will be at the desired elevation.

Before application of the final surface layers, it may be necessary to mechanically compress or compact the subsurface layers adjacent to the drainage channel 10 to ensure proper packing. Vibratory tamping or rolling machinery may be used which, if improperly applied, could damage the structure of the channel 10 and require expensive replacement. In particular, the machinery could break the bottom wall 15 and/or sidewalls 16 of the drainage channel 10 causing it to leak or even collapse. However, if the compressive force applied is too large and/or too close to the sidewall 16, the projection 34 will act as a mechanical fuse and shear away from the sidewall. This shearing will relieve the applied compressive load without fracturing the sidewalls 16 and will signal to the machinery operator to move away from the channel 10 before the channel is structurally destroyed.

With respect to the embodiment illustrated on the left-hand side of the drainage channel of FIGS. 1 and 2, a running track surface 11 may then be formed over the asphalt layer 47. The running track surface 11 is formed by pouring a moldable material 49 over the porous asphalt layer 47 and allowing the material to cure leaving a resilient and impervious surface. In a preferred embodiment, the moldable material 49 comprises a polymer, and more specifically a urethane polymer.

Before pouring the running track surface 11, however, an edge adapter 30 is typically mounted on the channel. Several advantageous embodiments of edge adapters 30 are illustrated herein and are described in more detail in U.S. Pat. No. 5,647,692, entitled "Edge Adapter for Athletic Playing Surface and Associated Method" to Charles E. Gunter filed concurrently herewith and assigned to the assignee of the present invention and which is incorporated herein by reference. For example, in a first embodiment illustrated in FIGS. 1 and 2, the edge adapter 30 includes a generally horizontal base portion 31 having a predetermined thickness, as discussed below. A continuous plug portion 32 extends downwardly from the base portion 31 and is dimensioned to fit within a corresponding longitudinal slot 33 formed in the upper surface 35 of the sidewall 16*a*.

This exemplary edge adapter also includes an upstanding portion 36 extending upwardly from the base portion 31 to act as a dam to restrain the moldable material 49 of a running track surface 11 while it cures, as shown in FIG. 2. In addition, the upper edge of the upstanding portion 36 preferably defines the maximum level to which the moldable material 49 is applied. When a thinner and less costly running track surface is desired, a temporary adapter (not shown) may be used having an upper edge lower than the permanent adapter so that a subsurface layer, such as an asphalt layer, can first be poured to a level above the upper surface 35 of the sidewall 16 and defined by the upper edge of the temporary adapter. The edge adapter 30 is preferably formed of a resilient and elastically deformable material. This feature is advantageous because it provides a relatively soft edge for the running track surface 11 which can prevent injury and which improves the "foot-feel" of the edge adapter relative to the resilient running track surface.

For purposes of illustration, an artificial turf surface 11 may be formed adjacent to the opposite side of the drainage channel 10. As shown in FIG. 2, a foam layer 50 is applied over the asphalt layer 47 having a thickness which places its upper surface at a level generally corresponding to the horizontal upper surface 35 of the adjacent sidewall 16. An artificial turf layer 51 is then laid over the foam layer 50.

In an alternative construction (not illustrated), the asphalt 47 and foam layers 50 may be replaced with one elastic or "E-layer" of the same thickness as the combined thicknesses of the asphalt and foam layers. The "E-layer" is resilient and serves a cushioning function to help prevent injury to athletes. The "E-layer" is typically formed of a plurality of discrete individual rubber particles held together in a binder.

Figure 2B:
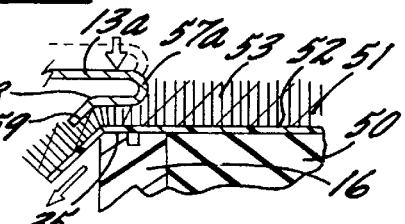
Figure 2C:
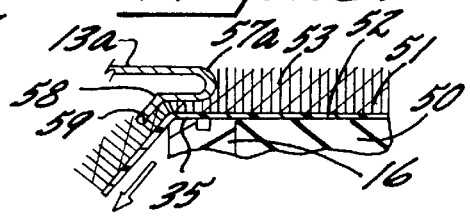

As can be best seen in FIGS. 2A–2C, the artificial turf layer 51 includes a backing layer 52 and a plurality of stiff but pliable artificial fibers 53 secured to the backing layer. The artificial turf layer thus has a predetermined thickness which may be reduced to a predetermined crush height by the bending and folding over of the artificial fibers 53 when subjected to a compressive load.

Figure 3:
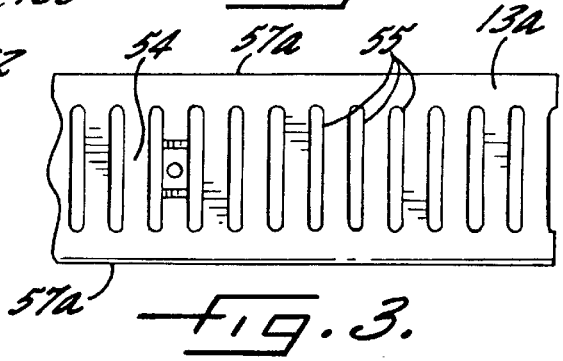
FIG. 3 is a top view of the first embodiment of a grate according to the present invention which illustrates the plurality of openings defined therein.

A grate 13*a* according to a first embodiment of the invention is preferably used to secure the edge portion of the artificial turf layer 51 to the channel sidewall 16. In particular, the first embodiment of the grate 13*a* includes an elongate central portion 54 formed of a strong and corrosion resistant material such as galvanized steel. As is illustrated in FIG. 3, the central portion 54 is provided with a plurality of openings 55 to permit runoff from the artificial turf layer 51 to pass through the openings and into the drainage channel 10. The grate 13*a* and openings 55 may be formed by stamping a blank from a flat sheet of strip steel on a press. Accordingly, the openings 55 may have flanged edges which preferably extend downwardly from the central portion 54. The grate 13*a* may be stamped more than once to provide well-defined corners for the flanged edges of the openings 55, thereby allowing headed fasteners, such as bolts, to be countersunk to a level even with or below the upper surface of the grate as shown in FIG. 2.

The central portion 54 defines opposed exterior edges 57*a* which may be formed by bending a peripheral portion of the blank downwardly around a mandrel. The opposed exterior edges 57*a* are thus provided with a rounded shape having a predetermined thickness. As discussed below, this thickness is preferably substantially equal to the difference between the predetermined thickness and the crush height of the artificial turf layer 51. This thickness is preferably about 8 mm in one embodiment.

Each of exterior edges 57*a* of the grate preferably defines a downwardly extending wall portion 58 connected to the exterior edge. The wall portion 58 is interior of the exterior edge 57*a* to which it is connected and preferably includes an engagement surface 59 for applying a downwardly directed engagement force to the edge portion of the artificial turf layer 51 in the manner discussed below. The engagement surface 59 is preferably planar and extends both downwardly and inwardly in a direction away from the exterior edge 57*a* to which the wall portion 58 is attached. In one embodiment, the engagement surface 59 defines an acute angle of between about 60° and 80° relative to the central portion 54 and, more particularly, an acute angle of about 71°. The wall portion 58 may also include a serrated edge or a plurality of projections for further engaging the edge portion of the artificial turf layer 51.

The installation of the first embodiment of the grate 13*a* is illustrated in FIGS. 2A–2C. The artificial turf 51 is first pulled taut over the foam layer 50 and the edge portion is placed over the upper surface 35 of a first sidewall 16. For the illustrated embodiment in which a running track surface is adjacent to the artificial turf surface, an edge adapter is preferably mounted to the upper surface of the second sidewall. The grate 13*a* is then placed over the open top 17 of the channel 10 with one exterior edge 57*a* above the base portion 31 of the edge adapter 30 and the other exterior edge above the edge portion of the artificial turf 51. A fastener, such as a tightening bolt 26, can then threaded into the locking strap 25 to draw the grate 13*a* downwardly against the channel 10 as the bolt is tightened.

As the grate 13*a* is drawn toward the channel 10, the wall portion 58 and engagement surface 59 contact the exposed edges of the artificial turf fibers 53. With continued tightening, the fibers 53 begin to fold over and become compressed and the wall portion 58 and engagement surface 59 (and any serrations or projections thereon) begin to engage the edge portion of the artificial turf 51, as shown in FIG. 2B.

With further continued tightening of the grate 13*a*, the downwardly extending component of the engagement surface 59 draws the edge portion of the artificial turf 51 into the channel 10. Moreover, the inwardly extending component of the engagement surface 59 adjacent to each of the exterior edges 57*a* causes the grate 13*a* to center itself relative to the sidewalls 16 of the drainage channel 10 as the grate 13*a* is tightened. Accordingly, when fully tightened, the artificial turf 51 is drawn further into the channel 10 than the artificial turf was before the grate 13*a* was fastened and, as a result, a preferable tightening of the artificial turf will has been accomplished.

In addition, the artificial turf layer 51 between the wall portion 58 and the upper surface 35 of the sidewall 16 will have been crushed to its predetermined crush height and thus will be securely anchored to the channel 10. Accordingly, in some athletic facilities, the drainage channel 10 may not even need to provide drainage, but can serve to anchor the artificial turf surface and/or provide edging for the running track surface.

As discussed above, the base portion 31 of the edge adapter 30 and the crush height of the artificial turf 51 are substantially equal and, accordingly, the central portion 54 of the grate 13*a* will preferably be substantially level, e.g. horizontal, once fastened. Moreover, because the exterior edge 57*a* has a predetermined thickness substantially equal to the difference between the predetermined thickness of the artificial turf 51 and its crush height, the upper surface of grate 13*a* will be level with the upper surface of the artificial turf. Due, at least partially to the predetermined thickness of the base portion of the edge adapter, the grate is also level with the upper surface of the running track. Accordingly, athletes, spectators or wheeled vehicles can readily pass over the drainage channel and between the various playing surfaces without encountering a trip hazard.

Figure 5:
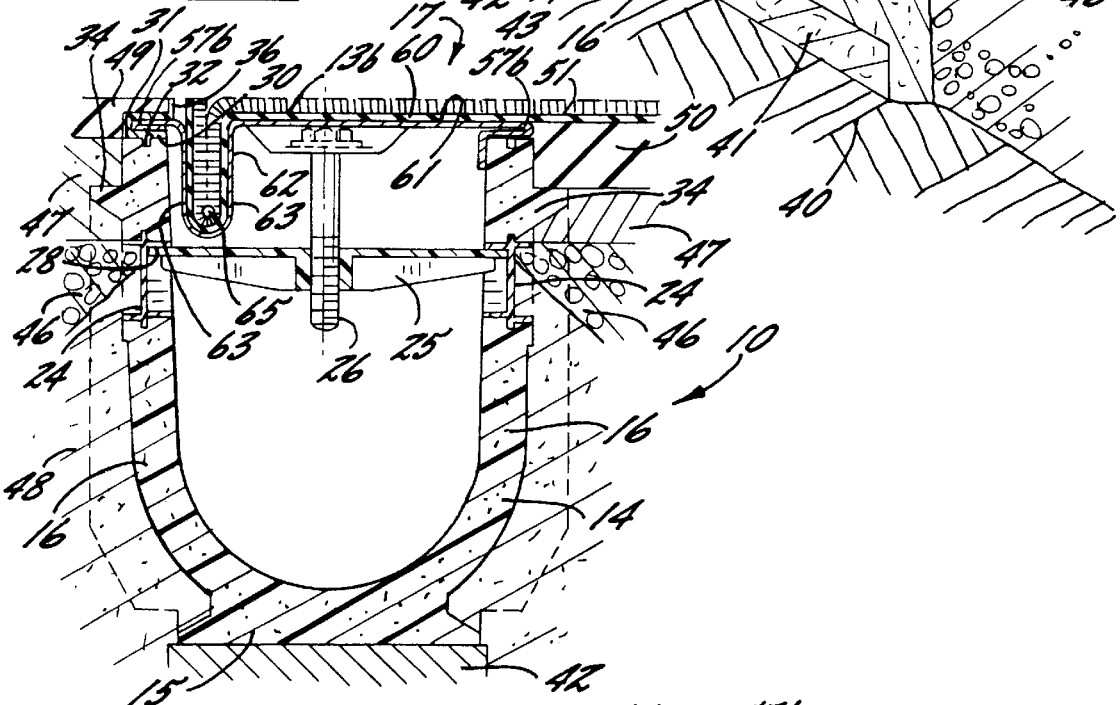
FIG. 5 is a sectional view of the drainage channel of FIG. 4 taken along line 5—5 of FIG. 4 which illustrates the elongate slot defined by the grate of this embodiment in which the edge portion of the artificial turf surface is tucked.
Figure 6:
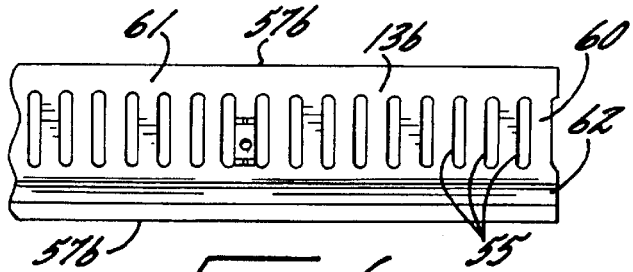
FIG. 6 is a top view of the second embodiment of a grate according to the present invention which illustrates the elongate slot and the plurality of openings defined therein.

A second embodiment of a grate 13*b* according to the present invention is illustrated in FIGS. 4–6 and is also typically disposed between a running track surface 11 and an artificial turf playing surface 12. For safety and aesthetic reasons, the artificial turf of this embodiment substantially covers the grate 13*b*. Since the artificial turf layer 51 is substantially porous, however, liquid runoff can pass through the artificial turf and into the channel 10.

The grate 13*b* of the second embodiment is generally formed in the same manner as the first embodiment 13*a* and includes an elongate central portion 60 having an upper surface 61 extending between opposed exterior edges 57*b*. The exterior edges 57*b* of the second embodiment 13*b* are generally thinner or flatter than the edges 57*a* of the first embodiment 13*a*, however, and typically do not include downwardly extending wall portions 58.

The grate 13*b* does define an elongate slot 62 which is integrally formed in the central portion 60 of the grate 13*b* for securing the edge portion of the artificial turf 51. In particular, the elongate slot 62 includes a pair of sidewalls 63 extending downwardly into the drainage channel 10 from the upper surface 61 of the central portion 60. The sidewalls 63 may be connected at lower portions thereof and may define a plurality of openings in the lower portions to allow runoff to pass therethrough into the drainage channel 10.

The elongate slot 62 has a predetermined width, defined by the distance separating the sidewalls 63, which is at least as great as the predetermined crush height of the artificial turf surface 51 so that the slot can receive and frictionally engage the edge portion of the artificial turf surface. Preferably, the slot 62 has a width at least as great as twice the predetermined crush height of the artificial turf surface 51 such that the edge portion of the artificial turf can be frictionally engaged within the slot in a folded or overlapped position. In one embodiment, the slot 62 has a width between about 10 mm and 25 mm and, more particularly, about 16 mm.

Accordingly, to secure the edge of the artificial turf 51, the grate 13*b* is secured in the manner discussed above and the artificial turf layer 51 is laid over the grate. The edge portion of the artificial turf 51 is then tucked, preferably in the folded position shown in FIGS. 4 and 5, within the elongate slot 62 defined by the grate 13*b*. The edge portion of the artificial turf 51 is then frictionally engaged within the slot 51. Preferably, a removable securing member 65, such as the illustrated cord, is forced into the slot 62 after the artificial turf 51 has been tucked therein, to increase the frictional engagement force.

An edge adapter 30 is also used with the grate 13*b* of FIGS. 4 and 5 and includes a base portion 31 and a downwardly extending plug portion 32 as in the adapter discussed above. The adapter 30 also includes an upstanding portion 36 for restraining the moldable material 49 during the formation of the running track surface 11. The upstanding portion 36 of this embodiment of the edge adapter can include a first vertical wall portion and a second vertical wall portion offset therefrom by a horizontal wall portion. The base portion 31 and horizontal wall portion are separated by a distance corresponding to the height of the first vertical wall portion. This distance is preferably large enough to snugly accommodate the exterior edge 57*b* of the grate 13 and, in one embodiment, is preferably about 4 mm.

The moldable material 49 for the running track 11 can thus be poured against the upstanding portion 36 such that some of the material will flow over the horizontal wall portion and against the second vertical wall portion. Accordingly, the edge of the running track surface 11 will extend to a position immediately adjacent to the elongate slot 62 such that substantially the entire grate 13*b* is covered.

Figure 8:
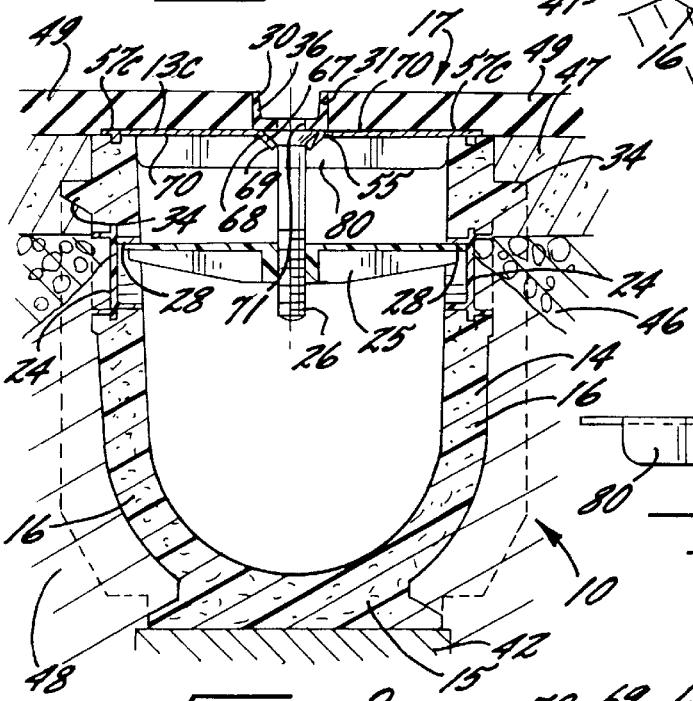
FIG. 8 is a sectional view of the drainage channel of FIG. 7 taken along line 8—8 of FIG. 7 which illustrates this third embodiment of the grate and the generally U-shaped edge adapter supported by the grate which defines respective edges of the impervious athletic surface.

It may be desired to form a running track surface 11 on both sides of the drainage channel 10. According to one aspect of the invention, it is preferable to form part of one or both of the impervious running track surfaces 11 over the grate 13*c*, as illustrated in FIGS. 7 and 8, to minimize the exposed surface of the grate. A third embodiment of a grate 13*c* according to the present invention is provided for such a configuration.

Figure 9A:
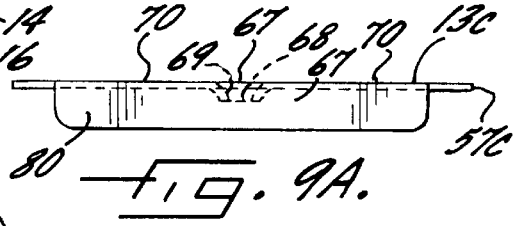
FIG. 9A is a sectional view of the third embodiment of the grate according to the present invention taken along line 9A—9A of FIG. 9 and depicting the downturned end portion of the grate which effectively aligns and centers this embodiment of the grate over the open top of a drainage channel.
Figure 9:
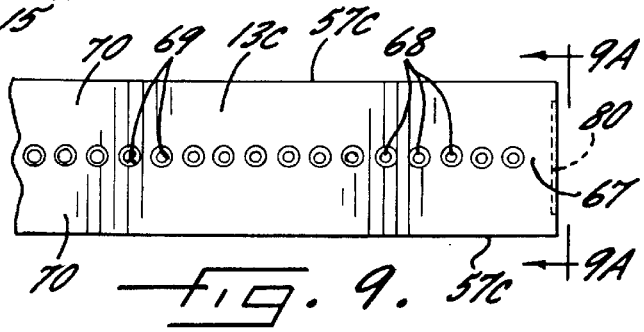
FIG. 9 is a top view of the third embodiment of a grate according to the present invention which illustrates the plurality of linearly disposed, spaced apart openings defined therein.

The third embodiment of the grate 13*c* is illustrated in FIGS. 7–9 and advantageously includes a central portion 67 having a plurality of openings 68 formed therein in the same manner as the first and second embodiments discussed above. More particularly, the grate 13*c* may be stamped twice so that the flanged edges 69 of the openings 68 clearly define a countersunk surface for the bolt 26 as can be seen in FIG. 8. The bolt 26 can thus be tightened down to a level below the upper surface of the grate 13*c*. The opposed ends of the elongate central portion 60 of this embodiment of the grate may include downturned portions 80. Preferably, the width of the downturned portions 80 is substantially equal to the width of the open top of the drainage channel such that the downturned portions fit within the open top and serve to align and center the grate 13*c* over the drainage channel 10.

A pair of opposed edge portions 70 are provided on either side of the central portion 67 adjacent respective ones of the exterior edges 57*c* of the grate. The opposed edge portions 70 are preferably continuous so as to not have any openings formed therein. Thus, the running track surface 11 can be formed at least partially over one or both edge portions 70 and adjacent to the central portion 67 of the grate of this embodiment as shown in FIGS. 7 and 8.

A third type of edge adapter 30 for the third embodiment of the grate 13*c* is illustrated in FIGS. 7 and 8. The edge adapter 30 of this embodiment includes a horizontally extending base portion 31 and a pair of upstanding portions 36 extending upwardly from the base portion to create a generally U-shaped edge adapter. The upstanding portions 36 thus act as a dam in the manner discussed above to restrain the moldable material 49 of the running track surface 11 while being formed over the grate 13*c*. After the moldable material 49 has cured, the edge adapter 30 may be removed leaving adjoining running track surfaces 11 having adjacent well-defined edges. Alternatively, the edge adapter 30 could be formed of a degradable material such that the adapter disappears over time.

The edge adapter 30 according to the third embodiment may also be permanent, however, and formed of the same resilient and elastically deformable material of the first and second embodiments. The base portion 31 may be advantageously provided with a plurality of openings 71 which may be sized and spaced so as to be alignable with the openings 68 in the grate 13*c*. A plurality of fasteners (not shown), such as rivet-like fasteners, may be provided in selected aligned openings of the edge adapter 30 and grate 13*c* to secure the adapter to the grate. Accordingly, runoff will flow over the impervious running track surfaces 11, over the upstanding portions 36 of the edge adapter 30, through the aligned openings 71, 54 in the base portion 31 and the grate 13*c*, and into the drainage channel 10.

While the third embodiment of the grate 13*c* illustrated and described herein includes a number of openings 68 formed linearly in a central portion 67 of the grate, the grate of this embodiment could, instead, define a number of openings in other locations offset from the center, such as a row of linearly disposed openings formed in an edge portion 70 of the grate. In addition, the grate of this embodiment could define several rows of openings formed linearly along the length of the grate without departing from the spirit and scope of the present invention.

Therefore, the drainage channel 10 and associated grates 13 of the present invention permit the drainage channel to be installed adjacent a number of different types of athletic playing surfaces, such as running track surfaces and artificial turf surfaces. In addition, the various embodiments of the grate 13 can support at least a portion of the various playing surfaces to reduce the surface area of the grate which is exposed. In addition, the grate 13 is preferably configured such that the upper surfaces of the grate and the playing surfaces are level, thereby reducing trip hazards and allowing athletes, spectators and vehicles to readily pass thereover. Finally, the drainage channel 10 including the various embodiments of the grates of the present invention continues to provide drainage for the athletic playing surfaces while defining an edge of the running track surface or securing the edge portion of an artificial turf surface.

The invention has been described in considerable detail with reference to preferred embodiments. However, many changes, variations, and modifications can be made without departing from the spirit and scope of the invention as described in the foregoing specification and defined in the appended claims. For example, while the drainage channels, edge adapters and grates are described in conjunction with athletic playing surfaces, these drainage system components can border and provide drainage for other surfaces without departing from the spirit and scope of the present invention.

That which is claimed is:

1. A method of securing an edge portion of an artificial turf surface to a drainage channel with a grate, wherein the grate defines an elongate slot which extends downwardly into the drainage channel from an upper surface of the grate, the method comprising the steps of:

disposing an edge portion of the artificial turf surface over at least a portion of the upper surface of the grate;

supporting the edge portion of the artificial turf surface over at least a portion of the drainage channel with the grate;

tucking the edge portion of the artificial turf surface within the elongate slot defined by the grate; and frictionally engaging the edge portion of the artificial turf surface within the elongate slot such that the artificial turf surface is thereby secured to the grate.

2. A method as defined by claim 1 wherein said frictional engagement step comprises the step of removably disposing a securing member within the elongate slot defined by the grate to further secure the edge portion of the artificial turf surface within the elongate slot.

3. A drainable athletic field comprising:

a drainage channel comprising:

a bottom wall; and a pair of sidewalls extending upwardly from opposed edges of said bottom wall to thereby define an open top;

a grate extending over the open top of the drainage channel and defining a plurality of openings therein; and an impervious athletic surface disposed over a first portion of said grate such that said grate at least partially supports said impervious athletic surface over a portion of the open top of the drainage channel to thereby reduce the exposed portion of said grate, wherein a second portion of said grate which defines at least some of the openings is free of said impervious athletic surface such that runoff from said impervious athletic surface can flow through the openings and into said drainage channel.

4. A drainable athletic field as defined by claim 3 wherein said grate defines a plurality of linearly disposed, spaced apart openings.

5. A drainable athletic field as defined by claim 4 wherein the plurality of linearly disposed, spaced apart openings are defined by a central portion of said grate.

6. A drainable athletic field as defined by claim 3 further comprising an edge adapter for defining an edge of said impervious athletic surface, said edge adapter comprising:

a base portion for supporting said edge adapter on said grate and defining a plurality of openings for allowing runoff from said impervious athletic surface to flow through said edge adapter and said grate and into said drainage channel; and an upstanding portion extending upwardly from said base portion for defining the edge of said impervious athletic surface.

7. A drainable athletic field as defined by claim 6 further comprising a plurality of fastening members extending through said openings in said base portion for fastening said edge adapter to said grate.

8. A drainable athletic field as defined by claim 3 wherein said grate comprises a central portion defining the plurality of openings therein and a pair of opposed edge portions, and wherein said impervious athletic surface extends over both opposed edge portions of said grate.

9. A drainable athletic field as defined in claim 2 further comprising a generally U-shaped edge adapter, disposed upon the central portion of said grate, for defining respective edges of said impervious athletic surface.

10. A drainable athletic field as defined in claim 9 wherein said edge adapter comprises:

a base portion for supporting said edge adapter on the central portion of said grate and defining a plurality of openings for allowing runoff from said impervious athletic surface to flow through said edge adapter and said grate and into said drainage channel; and a pair of upstanding portions extending upwardly from opposed sides of said base portion for defining respective edges of said impervious athletic surface.

11. A drainable athletic field as defined in claim 3 wherein said impervious athletic surface is formed of a polymeric material.

12. A method of forming a drainable athletic field comprising the steps of:

providing a drainage channel which includes a pair of sidewalls defining an open top therebetween for receiving runoff from the athletic field;

positioning a grate between the sidewalls and over the open top of the drainage channel, wherein the grate defines a plurality of openings extending therethrough; and covering a first portion of the grate with an impervious athletic surface such that the grate at least partially supports the impervious athletic surface, said covering step comprising the step of leaving a second portion of the grate which defines at least some of the openings free of the impervious athletic surface such that runoff from the impervious athletic surface can flow through the openings defined by the grate and into the drainage channel.

13. A method as defined by claim 12 further comprising the step of positioning an edge adapter on the grate prior to said covering step, wherein the edge adapter comprises a base portion for supporting the edge adapter on the grate and an upstanding portion extending upwardly from the base portion for defining an edge of the impervious athletic surface once the impervious athletic surface covers the first portion of the grate.

14. A method as defined by claim 13 wherein the base portion of the edge adapter defines a plurality of openings, and wherein said step of positioning the edge adapter on the grate comprises the step of aligning the at least some of the openings defined by the edge adapter with at least some of the openings defined by the grate such that runoff from the impervious athletic surface can flow through the edge adapter and the grate and into the drainage channel.

15. A method as defined by claim 14 wherein said aligning step comprises the step of fastening the edge adapter to the grate, said fastening step comprising the step of extending a plurality of fastening members through the openings defined by both the grate and the base portion of the edge adapter.

16. A method as defined by claim 13 wherein said covering step comprises the steps of:

pouring a moldable material over the first portion of the grate;

restraining the moldable material with the upstanding portion of the edge adapter to prevent the moldable material from covering the second portion of the grate which defines the openings; and curing the moldable material to form the impervious athletic surface having an edge defined by the upstanding portion of the edge adapter.

17. A method as defined in claim 16 wherein said pouring step comprises pouring a polymeric material.

18. A method according to claim 1 wherein said grate defines a plurality of openings through which liquid runoff is received, and wherein disposing the edge portion of the artificial turf surface over at least a portion of the upper surface of the grate comprises disposing the edge portion of the artificial turf surface over at least a portion of the grate that defines the openings such that liquid runoff can pass through the artificial turf surface and through the openings into the drainage channel.

* * * * *

UNITED STATES PATENT AND TRADEMARK OFFICE

CERTIFICATE OF CORRECTION

PATENT NO. : 6,132,137
DATED : October 17, 2000
INVENTOR(S) : Gunter

It is certified that error appears in the above-identified patent and that said Letters Patent is hereby corrected as shown below:

Column 16,
Line 18, "claim 2" should read -- claim 8 --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*